US005279666A

United States Patent [19]

Kastenhuber et al.

[11] Patent Number: 5,279,666

[45] Date of Patent: Jan. 18, 1994

[54] HOT BRIDLE FOR METAL TREATING LINE

[75] Inventors: Richard Kastenhuber; C. P. Mohan; Donald F. Whitacre, Jr., all of Salem, Ohio

[73] Assignee: The Electric Furnace Company, Salem, Ohio

[21] Appl. No.: 862,442

[22] Filed: Apr. 2, 1992

[51] Int. Cl.[5] ..... B05C 3/12; C23C 2/00

[52] U.S. Cl. ..... 118/33; 118/65; 118/423; 118/673; 118/713

[58] Field of Search ..... 118/33, 65, 423, 673, 118/713; 226/21-23, 195; 72/38, 205

[56] References Cited

U.S. PATENT DOCUMENTS 3,602,191 8/1971 Gorton ..... 118/33

4,519,337 5/1985 Ono et al. ..... 118/33

FOREIGN PATENT DOCUMENTS 3020476 1/1988 Japan ..... 118/673

*Primary Examiner*—Matthew O. Savage

*Attorney, Agent, or Firm*—James H. Tilberry

[57] ABSTRACT

A hot bridle mechanism to tension and to guide metal strip at the exit of a metal strip processing line. A bridle comprising one or more roll means is positioned and enclosed in a sealed hood at the end of a line of interconnected heat treating and cooling enclosures, and maintained in a controlled atmosphere at substantially the same temperature as that of the strip. The roll means are adapted to selectively pivot in a horizontal plane in a controlled manner for the purpose of guiding the strip. The hood is stationary and the roll means are secured to a pivot frame which is adapted to pivot in a horizontal plane relative to the stationary hood. Flexible seals connect the stub shafts of the rolls in sealing engagement with the hood.

26 Claims, 13 Drawing Sheets

HOT BRIDLE FOR METAL TREATING LINE

BACKGROUND OF INVENTION

1. Field of Invention:

This invention relates in general to the field of metal strip heat treating and processing. More particularly, the invention relates to means for guiding metal strip through various heat treating and cooling furnaces. Specifically, the invention relates to means for tensioning and guiding metal strip in a metal strip processing line.

2. Description of Related Art:

It is customary to tension metal strip prior to entering and after exiting an annealing furnace, such as disclosed in U.S. Pat. No. 3,385,946 to D. G. Hatchard. Pairs of two roll bridle sets are also used to stretch metal strip therebetween, as shown in U.S. Pat. No. 4,079,615, to O. F. Noe. The tension of metal strip may also be controlled by positioning tension rolls intermediate the sections of multi-section furnaces as shown in U.S. Pat. No. 4,371,332 to Matsuo et al. A variation of this idea is shown in U.S. Pat. No. 4,375,283 to Shimoyam which utilizes a master speed hearth roll positioned between a plurality of helper rolls both forwardly and rearwardly of the master speed hearth roll. The tensioning means in the above-noted prior art devices are concerned with tensioning metal strip in annealing furnaces, but none of these prior art devices relates to guiding metal strip just prior to exiting a strip processing line. Specifically, these prior art devices do not deal with the problems of utilizing a hot bridle to both tension and to guide metal strip during strip processing.

By way of example, in the hot dipping art, U.S. Pat. No. 4,519,337 to Ono et al. discloses a hot bridle downstream of the heat treatment furnaces and upstream of the metal coating means. This device utilizes motor-driven rolls to maintain differential strip tension upstream and downstream of the hot bridle. However, the hot bridle rolls are mounted in stationary bearing housings, thereby rendering the rolls incapable of instant adjustment to prevent the strip from drifting to either side of the rolls. The roll seals used by Ono et al. are also stationary, which further renders any quick strip guiding adjustment of the rolls very difficult, if not impossible. The Ono et al. hot bridle hood is integral with the coating line per se, as is conventional with prior art roll hoods positioned just upstream of the coating bath.

SUMMARY OF THE INVENTION

In the metal strip processing industry, metal strip is customarily paid off from a coil of metal strip and fed into a strip processing line, which may include an assortment of metal treating and processing equipment. Such equipment may include strip cleaning equipment, strip leveling rolls, preheat furnaces, annealing furnaces, cooling furnaces, support rollers, drive rolls, strip reduction rolls, strip tempering rolls, bridle rolls, and strip recoil equipment.

As used in this application, a bridle is defined to mean one or more motor driven rolls in a metal strip processing line about which the strip is directed to pass in a path which requires the strip to partially wrap about each roll in the bridle. The wrap of strip about a roll provides the frictional grip between the strip and the roll. The greater the wrap, the greater is the grip. With sufficient wrap between strip and the bridle rolls, motorized bridle rolls can be used to assist in adjusting the tension of the strip as it passes through the processing line. By driving the bridle rolls faster than the speed of the strip through the line, the strip tension in the line is increased. By reducing the speed of the bridle rolls to less than the speed of the strip, the tension of the strip in the line is reduced. This is the main purpose of bridle rolls in a coating line. Bridles installed exterior of the processing line are usually "cold" bridles. If bridles are installed within a heated portion of a processing line, such as an annealing furnace, the bridles may be referred to as "hot" bridles.

The subject invention is primarily concerned with hot bridles, but is not limited to a particular metal strip processing line. A strip galvanizing line has been chosen only for the purpose of describing a preferred embodiment of the invention.

The expressions "heating" and cooling" are relative terms as used in the coating of metal strip such as by hot dipping strip in molten zinc. This process is commonly known as hot dip galvanizing. Thus, in a typical hot dip galvanizing line in which steel strip is given a protective coating of zinc, the strip is customarily preheated to about 1200° F. in an open flame preheating furnace; final heated to from about 1400° F. to 1650° F. in a controlled atmosphere radiant tube furnace; and then cooled to about 850° F. in a jet cooling section of the galvanizing line. The strip is then at substantially the same temperature as the molten zinc.

Hot bridle rolls, positioned between the last cooling section and the molten zinc bath, are independently motor driven, and, as previously stated, it is the speed of the rolls which determines the tension of the strip in the galvanizing line. However, on the downstream side of the hot bridle, slowing the roll speed has just the opposite effect on the strip, in that the tension in the strip is increased. Increased tension in this portion of the strip produces a beneficial result because tensioning the downstream portion of the strip stabilizes and flattens the strip, conditions necessary for more consistent, even application of zinc to the strip. As the strip leaves the molten zinc bath, the zinc is unevenly distributed over both sides of the strip. Air knives skim off the excess zinc from the strip, although some other suitable gas, such as nitrogen, may be used in lieu of air. The result is a uniform zinc coating. However, if the strip is not sufficiently tensioned, the force of the air knives and/or other external forces can cause movement of the strip, which movement in itself results in an uneven coating.

In addition to protecting the strip from parting under tension in the furnace during the heat treating process, and stabilizing the strip during the coating process, the subject inventive hot bridle is also adapted to keep the strip from drifting to one side or the other of the bridle rolls. This is an important control, since excessive drifting could result in contact between the strip edges and the stationary furnace structure of the line, which could result in serious damage to the strip. To prevent strip edge damage due to uncontrolled drifting, the hot bridle is mounted on a horizontal pivot frame which is adapted to arcuately pivot the horizontal axes of the rolls a few degrees clockwise or counterclockwise, as required. This controlled pivoting produces the desired result of arresting uncontrolled strip drift.

The rolls operate in a controlled atmosphere provided by an atmosphere-tight stationary roll hood, but are supported on roll mounts and driven by motor means mounted on the pivot frame outside of the hood.

Since the roll stub shafts are mounted in bearing housings outside of the hood, atmosphere sealing means are required around the roll stub shafts between the bearing housings and the hood stub shaft openings. Since the roll stub shafts are arcuately shiftable about a vertical axis, it is necessary that the sealing means be flexible to compensate for this roll stub shaft movement relative to the stationary roll hood. This sealing problem has been solved by the use of bellows-type seals enclosing the roll stub shafts in a manner that permits the roll stub shafts to move within the hood stub shaft openings without breaking the seals.

More specifically, the hot bridle hood is secured to the coating line frame and positioned in the strip pass line with means to permit the strip to pass therethrough. Both the hood strip entrance and exit are sealed against contamination from the atmosphere. In the preferred embodiment of the invention, the pivot frame, upon which are mounted the hot bridle rolls, the bridle roll motor drives, and the intermediate gear boxes, is positioned immediately beneath the hot bridle hood and connected thereto with pivot bearing means. Motor means are provided to horizontally shift the pivot frame about the vertical axis of the pivot bearing means responsive to a perceived drifting of the strip away from the center of the strip pass line.

The concept of an immobile hot bridle hood which houses shiftable hot bridle rolls to control strip alignment while at the same time maintaining the integrity of the controlled protective atmosphere in the hood is considered to be novel.

OBJECTS OF THE INVENTION

It is therefore among the objects of the invention to provide a hot bridle for use in a controlled protective atmosphere to receive heat-treated strip directly from a cooling section of a metal-treating line; to guide the strip into a bath of molten metal or to other strip processing means; to control the tension of the strip upstream of the hot bridle; to control the tension of the strip downstream of the hot bridle; and to prevent the strip from drifting to either side of the hot bridle rolls by means adapted to discretely adjust angulation of the rolls without contaminating the controlled atmosphere in the hot bridle hood.

BRIEF DESCRIPTION OF THE DRAWINGS

Further objects and advantages of the subject invention will be more fully understood by reference to the following detailed description of a preferred embodiment of the invention when taken in conjunction with the accompanying drawings, in which.

DESCRIPTION OF THE PREFERRED EMBODIMENT OF THE INVENTION

A horizontal hot dip zinc coating steel strip galvanizing line has been selected to describe the subject invention, but the inventive hot bridle roll mechanism is equally suitable for use in coating steel strip with other corrosion and/or rust resistant metals, such as various alloys of zinc, aluminum, and zinc aluminum. Accordingly, it is to be understood that the invention is not limited to the metallurgy of any particular hot dip. The invention is also suitable for use on strip metal processing lines unrelated to coating processes, such as strip metal annealing lines.

Figure 1:
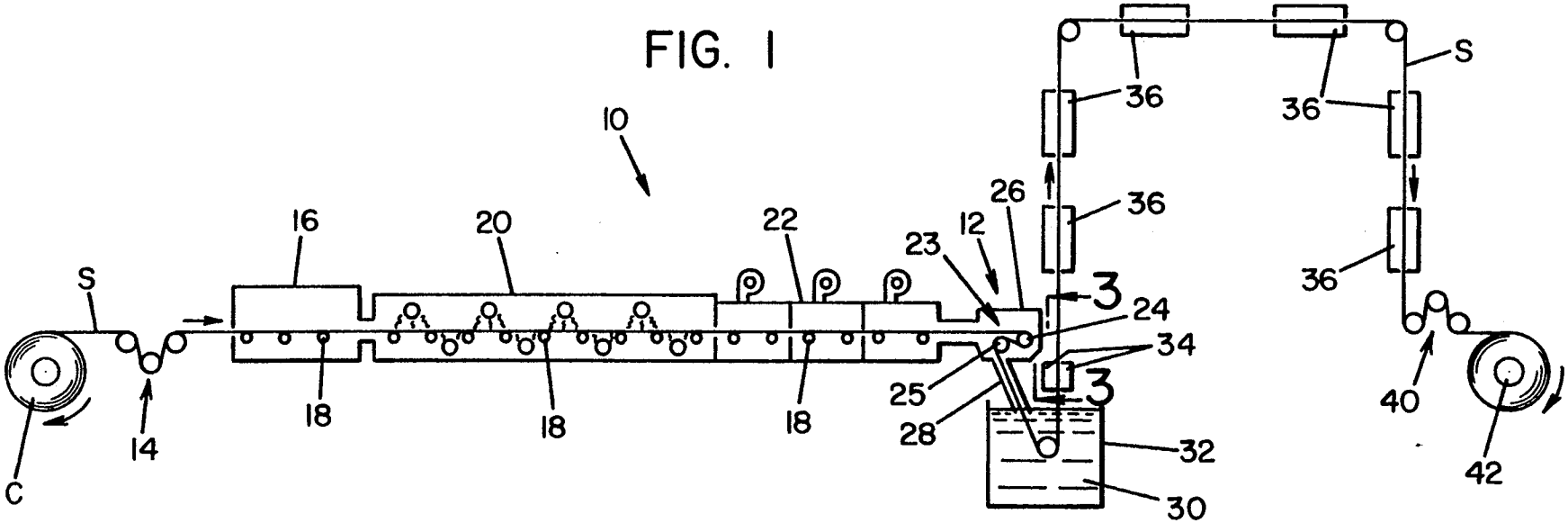
FIG. 1 is a vertical elevational view of a horizontal galvanizing line including a horizontal preheat furnace, horizontal radiant tube heating furnaces, a horizontal jet cooling furnace, and the inventive hot bridle.

FIG. 1 schematically shows the basic components of a prior art galvanizing line 10 in association with the inventive hot bridle mechanisms generally indicated at 12. Steel strip S is uncoiled from a coil of steel C and threaded through a three-roll cold bridle entrance strip tensioner 14 prior to entering a preheat furnace 16 where oil and other strip contaminants are burned from the strip by the gases of combustion of open flame burners. The temperature of the strip S is quickly elevated in the preheat furnace.

The strip S is carried on transport rollers 18 from the preheat furnace 16 into an atmosphere-controlled radiant tube heat treating furnace 20 for further heating to a desired critical temperature, and held, or soaked, for a predetermined critical time. The strip S then enters a cooling section 22 of the galvanizing line 10, where it is cooled down to about 850° F., the temperature of molten zinc. Leaving the cooling section 22, the strip is engaged by the two-roll hot bridle 23, which controls the tension of the strip both upstream and downstream of the hot bridle. The hot bridle rolls 24 and 25 are enclosed in an atmosphere-controlled hood 26. As the strip S passes from the hot bridle 23 it enters an atmosphere-controlled down chute 28, which protects the strip from contamination prior to entering the zinc bath 30 contained in a pot 32.

Because an excess of zinc clings to the strip after leaving the zinc pot 32, pairs of air knives 34 skim the excess zinc from the strip. After further cooling at cooling stations 36, the strip is then received by a three-roll cold bridle exit strip tensioner 40 and recoiled on exit coiler 42.

Figure 2:
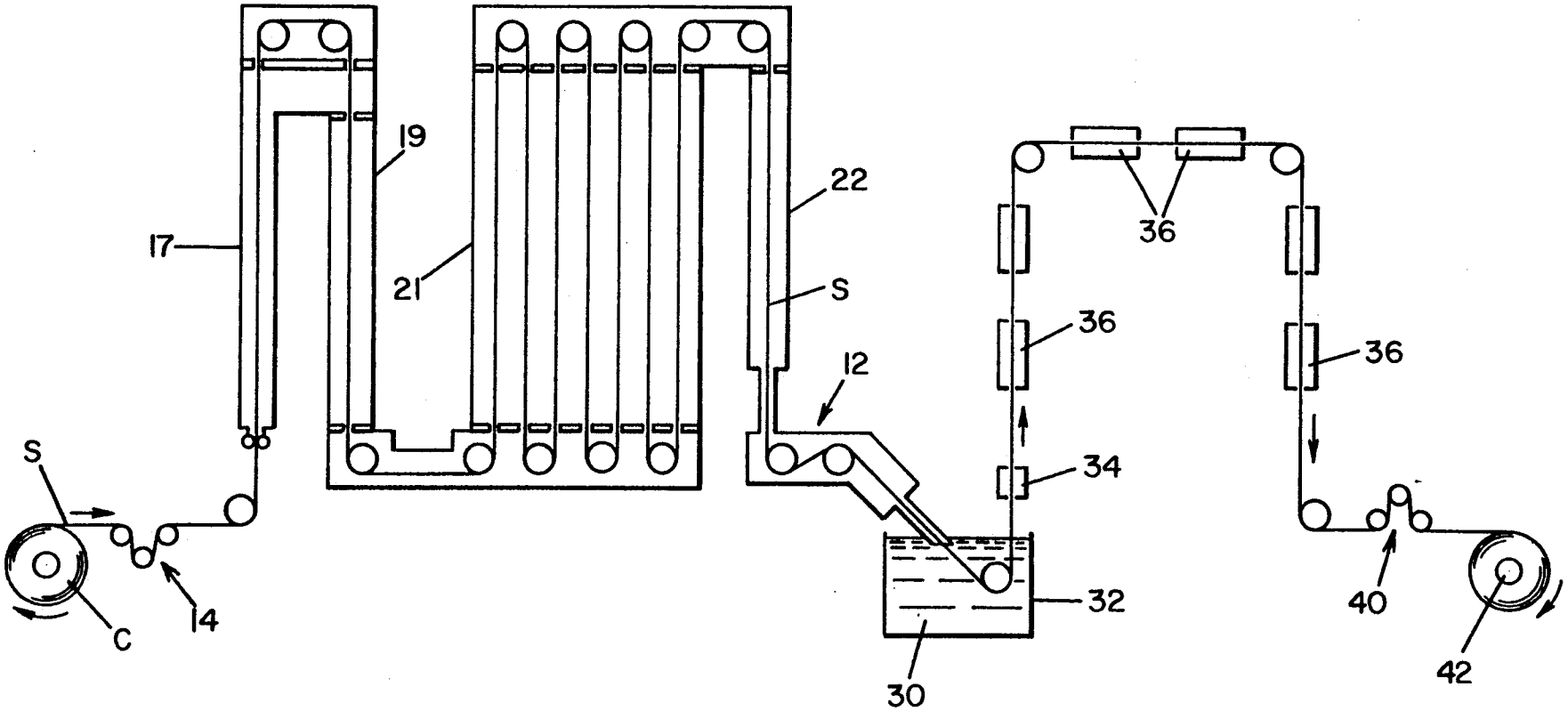
FIG. 2 is a vertical elevational view of a vertical metal strip coating line including a vertical unfired preheat tunnel, a vertical fired preheat furnace, a radiant tube heating furnace, a vertical cooling tunnel, and the inventive hot bridle.

FIG. 2 shows a vertical metal strip coating line in which a metal strip S, after having been unwound from a coil of strip C, enters an unfired vertical preheat furnace 17, from where it passes into a fired open flame vertical preheat furnace 19 to burn impurities from the surface of the strip and to quickly elevate the temperature of the strip. The strip is then passed on to a controlled atmosphere radiant heating furnace 21, where it is brought to a desired critical temperature and held or soaked for a predetermined critical period of time. Thereafter, the strip passes into a jet cooling section 22 to bring the temperature of the strip down to the temperature of the molten coating metal. The inventive hot bridle 12 is positioned between the exit end of the cooling furnace 22 and the molten metal pot 32.

There can be many variations to the above-described strip processing lines, all of which can benefit from the addition thereto of the inventive hot bridle. The invention will now be described in detail, in association with the galvanizing line shown in FIGS. 1 and 3 through 10.

Figure 3:
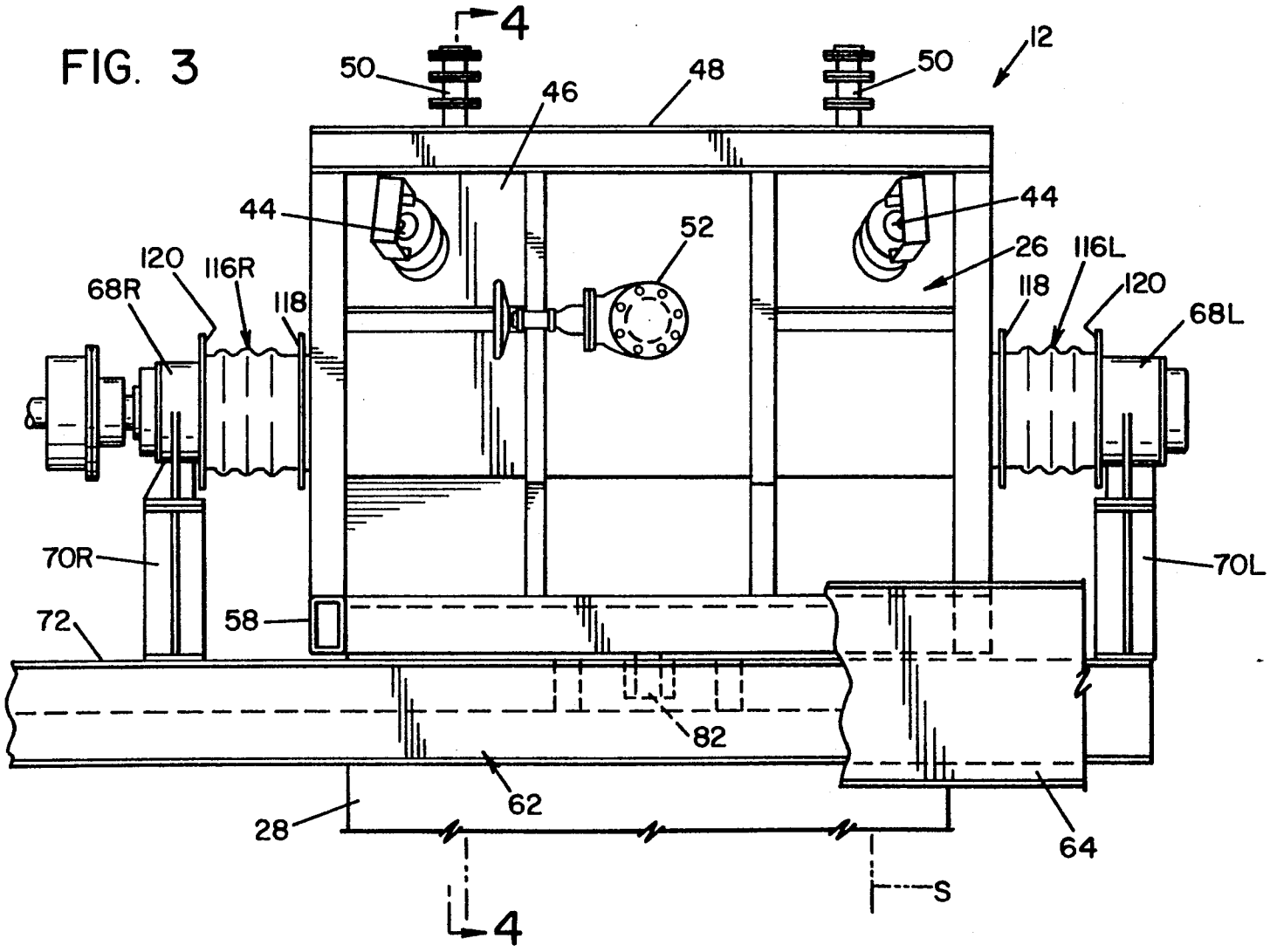
FIG. 3 is a front elevational view of the inventive hot bridle hood taken along the line 3—3 of FIG. 1.
Figure 4:
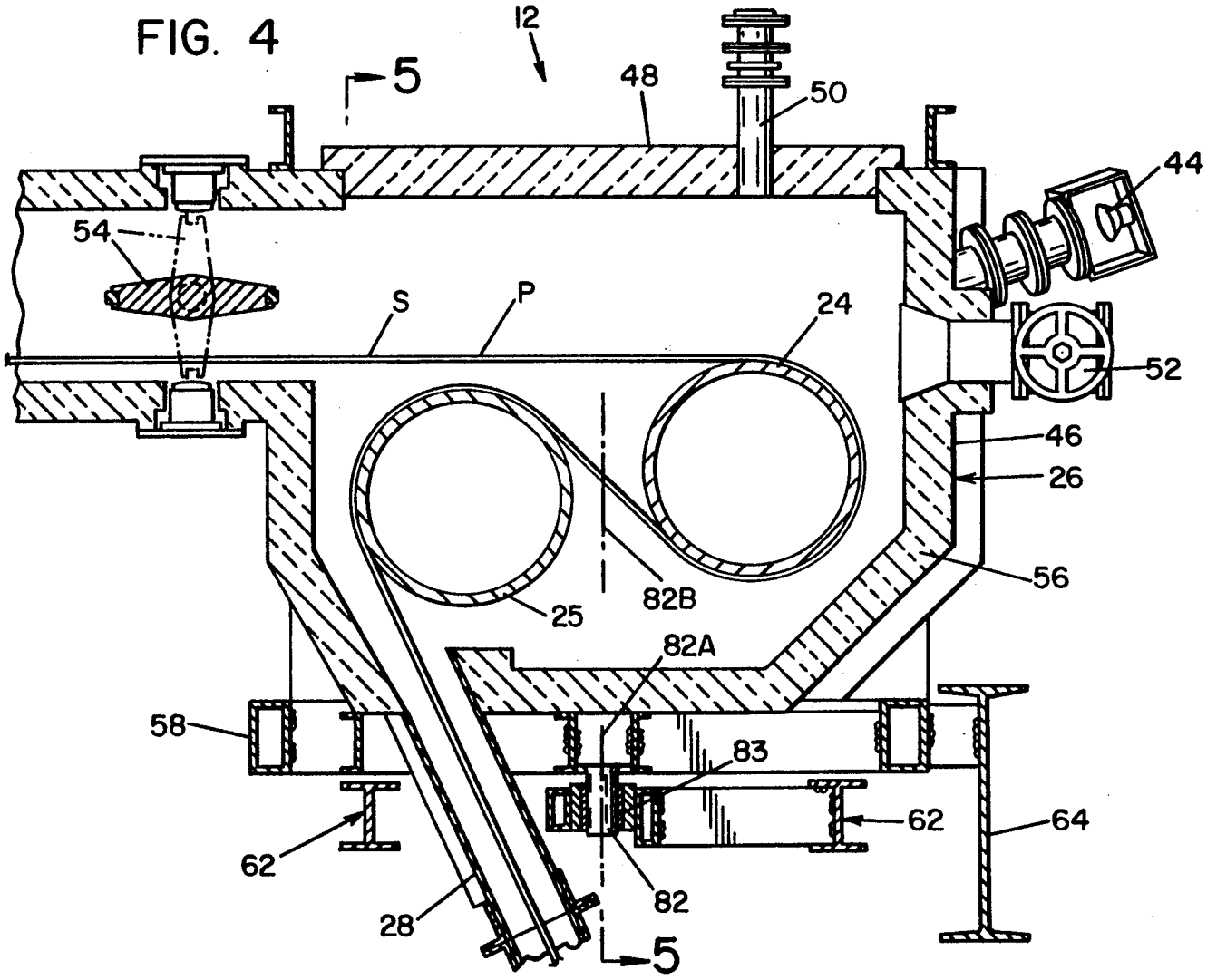
FIG. 4 is an elevational view in section of the inventive hot bridle and hood taken along the line 4—4 of FIG. 3.

FIGS. 3 and 4 illustrate an end view and a longitudinal sectional view, respectively, of the hot bridle hood and bridle rolls. When the strip S is delivered to the hot bridle hood 26, it has been cooled to a temperature below that of incandescence. In order to inspect the strip, a pair of spotlights 44 are mounted on the hood end wall 46 to illuminate the hood interior. Mounted on the hood roof 48 are a pair of peepsights 50. The gate valve 52 is provided for removing the strip-threading needle, a device well understood by those skilled in the art and therefore not shown. An atmosphere gate 54 shown both in the closed vertical position and in the horizontal open position, FIG. 4, serves to preserve the controlled atmosphere, usually nitrogen, in the adjacent cooling furnace 22, FIG. 1, when the hot bridle hood 26 is being serviced, repaired, or rethreaded with strip, in an air environment. The walls of the hood are insulated with a compressible refractory fiber packing 56.

FIG. 4 also shows the strip pass line P. The strip S makes a clockwise wrap around bridle roll 24 and then a counterclockwise wrap around bridle roll 25. The strip leaves bridle roll 25 and enters a down chute 28 which protects the strip from air contamination as it passes from the hood 26 into the molten zinc bath 30 of pot 32, FIG. 1. Hot bridle hood 26 is rigidly mounted on a hood frame 58, which is secured to the main frame 64, FIG. 4.

Figure 5:
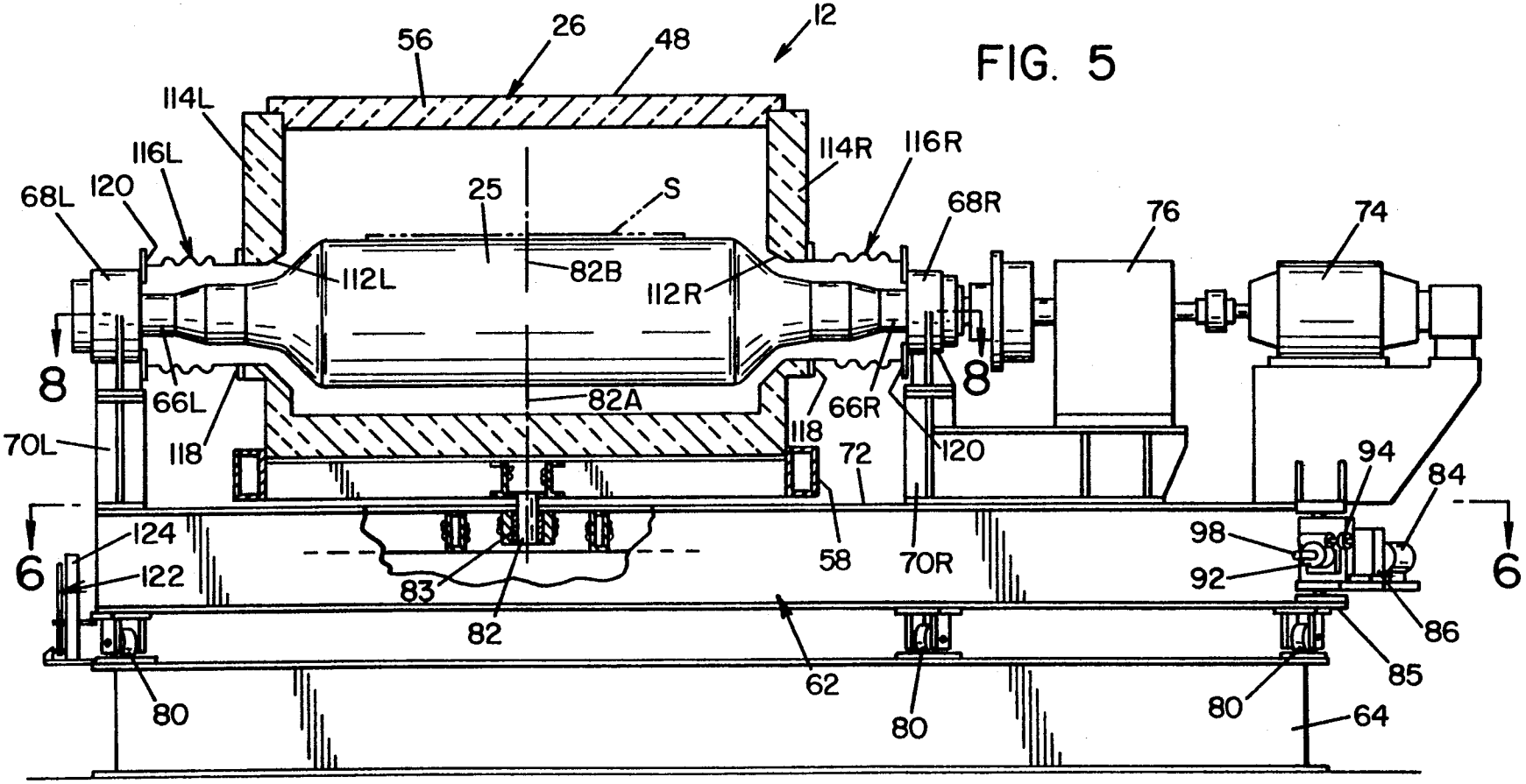
FIG. 5 is an elevational view partially in section of the inventive hot bridle mechanisms taken along the line 5—5 of FIG. 4.

FIG. 5 is a cross-sectional elevational view of the illustrative galvanizing line showing the pivot frame 62 which supports the bridle rolls 24 and 25, the drive motors 74, and the gear boxes 76. The galvanizing line base frame 64, in turn, supports the pivot frame 62. The roll stub shafts 66L and 66R are rotatably mounted in anti-friction bearing housings 68L and 68R, respectively. Bearing housings 68L and 68R are supported on support stands 70L and 70R. Support stands 70L and 70R are rigidly secured to the top deck 72 of pivot frame 62. The reduction gear boxes 76 drivingly connect the motor drives 74 to respective stub shafts 66R of rolls 24 and 25. Hood frame 58 is vertically spaced above deck 72 of pivot frame 62 sufficiently to permit free horizontal movement of pivot frame 62 therebeneath. It will be observed that the roll hood 26 does not support rolls 24 and 25. Roll hood 26 is rigidly fixed in place and comprises the exit end of the galvanizing line 10. Roll support stands 70L and 70R are rigidly secured to the deck 72 of pivot frame 62. Pivot frame 62 is mounted on wheels 80 secured to the undersides of the four corners of the stand which are aligned to permit pivotal movement of pivot stand 62 about vertical pivot post means 82. Pivot post means 82 interconnects pivot frame 62 with hood stationary frame 58 so that pivot frame 62 pivots relative to hood 26 and main frame 64, also shown in plan view in FIG. 6.

Pivot frame 62 is horizontal and pivots or arcuately shifts about the vertical center lien 82A of pivot post 82, FIGS. 4 and 5. Vertical center lien 82A normally intersects the longitudinal center line 64C, FIG. 8, of the processing line 10, FIG. 1. Vertical center lien 82A, although shown concentric with the vertical axis of arcuate movement 82B of the hot bridle rolls, and equidistant form the remote ends of the roll stub shafts 66, FIGS. 4 and 5, may be positioned relatively either downstream or upstream of the vertical axis of arcuate movement 82B of the hot bridle rolls 24 and 25.

Figure 6:
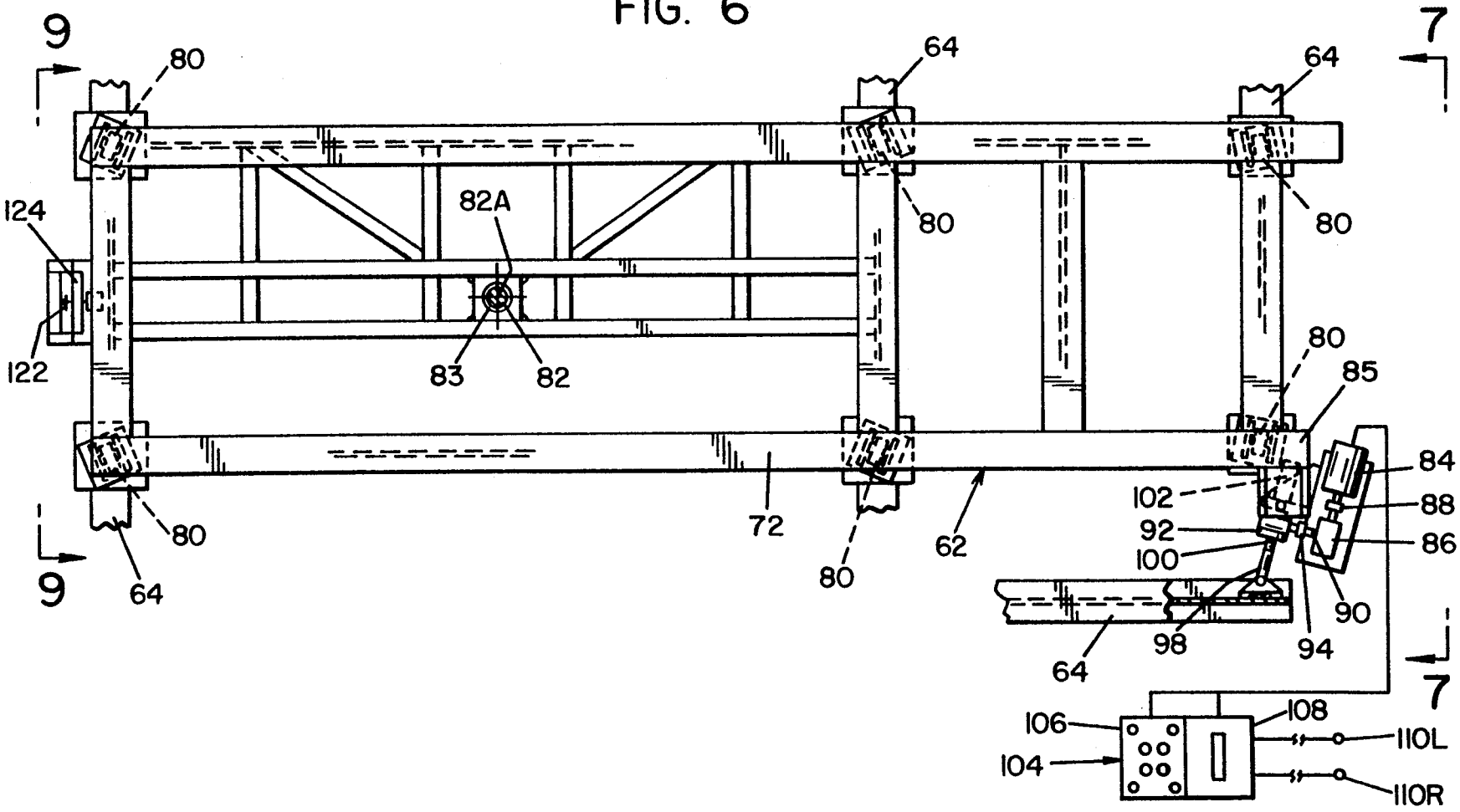
FIG. 6 is a plan view of the hot bridle pivot frame taken along the line 6—6 of FIG. 5.
Figure 7:
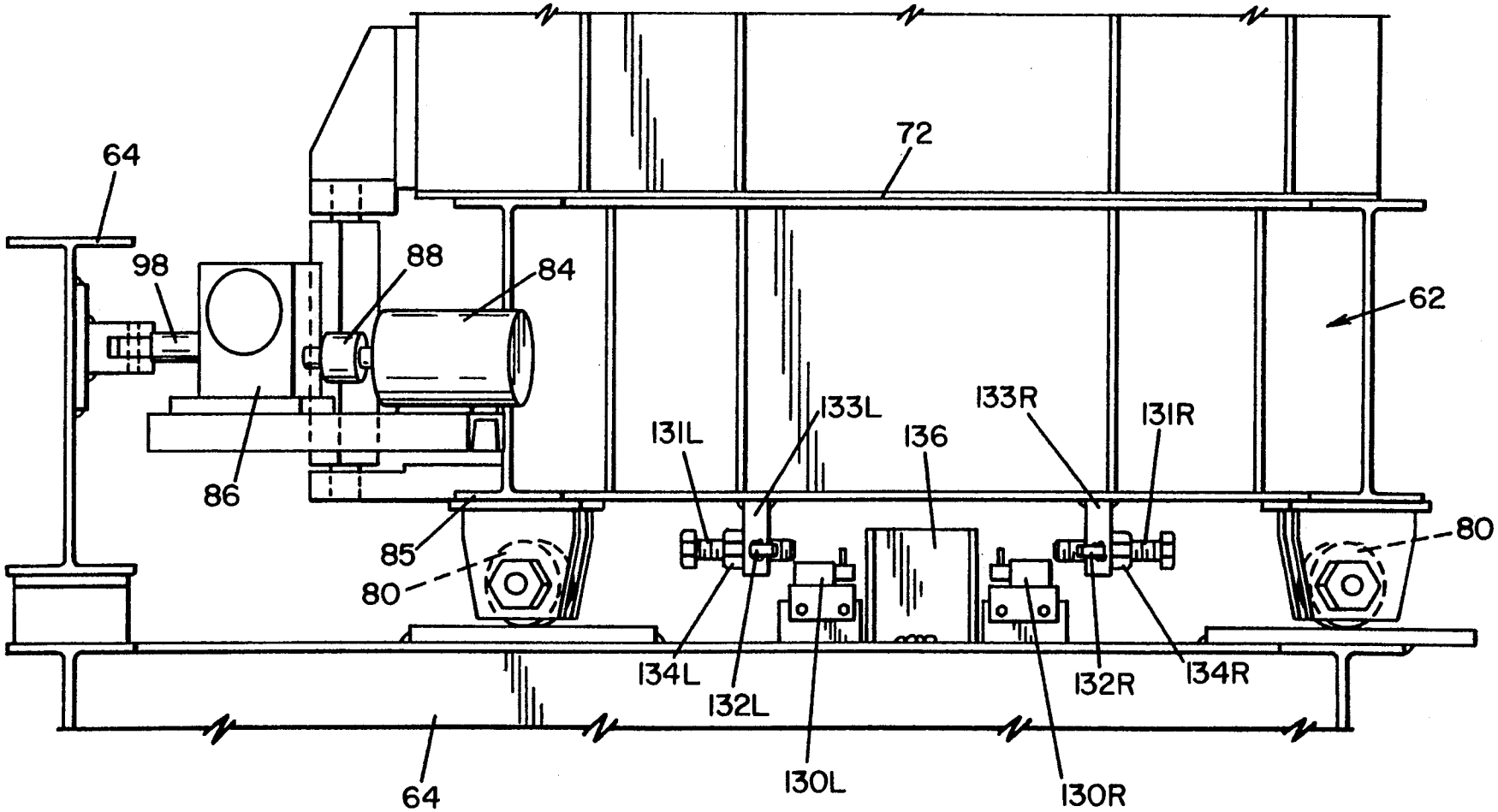
FIG. 7 is an elevational view of the hot bridle pivot frame taken along the line 7—7 of FIG. 6.

The drive means for pivoting the pivot frame 62 is shown in FIGS. 5, 6, and 7. As shown in plan view, FIG. 6, a drive motor 84 is mounted on a corner 85 of pivot frame 62 and is drivingly connected to a gear reduction box 86 by means of coupler 88. A power take-off drive shaft 90 projects from the inboard side of the gear reduction box and is drivingly connected to a screw jack body 92 by means of a coupler 94. The screw jack body 92 is pivotally anchored to a stationary portion of the main frame 64 by means of a shaft extension 98 of screw jack body 92. A threaded shaft 100 extends from the screw jack body 92, remote from shaft extension 98, for threaded rotatable engagement with a stationary threaded nut 102 secured to corner 85 of pivot frame 62. When drive motor 84 is energized, the drive train from the drive motor 84 to the threaded shaft 100 causes the threaded shaft 100 to rotate in stationary threaded nut 102, thereby causing the pivot frame 62 to pivot about pivot post means 82. Drive motor 84 is controlled by electronic control panel 104 which may be operated either by manual control component 106 or fully automatically by the computer component 108. If the controls are automatic, rather than manual, the preferred embodiment would be hydraulic, rather than the mechanical system described.

The computer 108 is adapted to receive electronic signals from sensors or other automatic control detector means 110L and 110R positioned on opposite sides of the strip pass line. If the strip S drifts beyond a predetermined tolerance either to the right or to the left of the strip longitudinal center line line, the closest automatic control detector means will detect the lateral movement of the strip and transmit a signal to the computer 108. The computer will analyze the signal, determine whether a strip correction is necessary, and, if so, send an appropriate command to motor drive 84 to shift pivot frame 62 clockwise or counterclockwise about pivot post means 82, as required.

Figure 8:
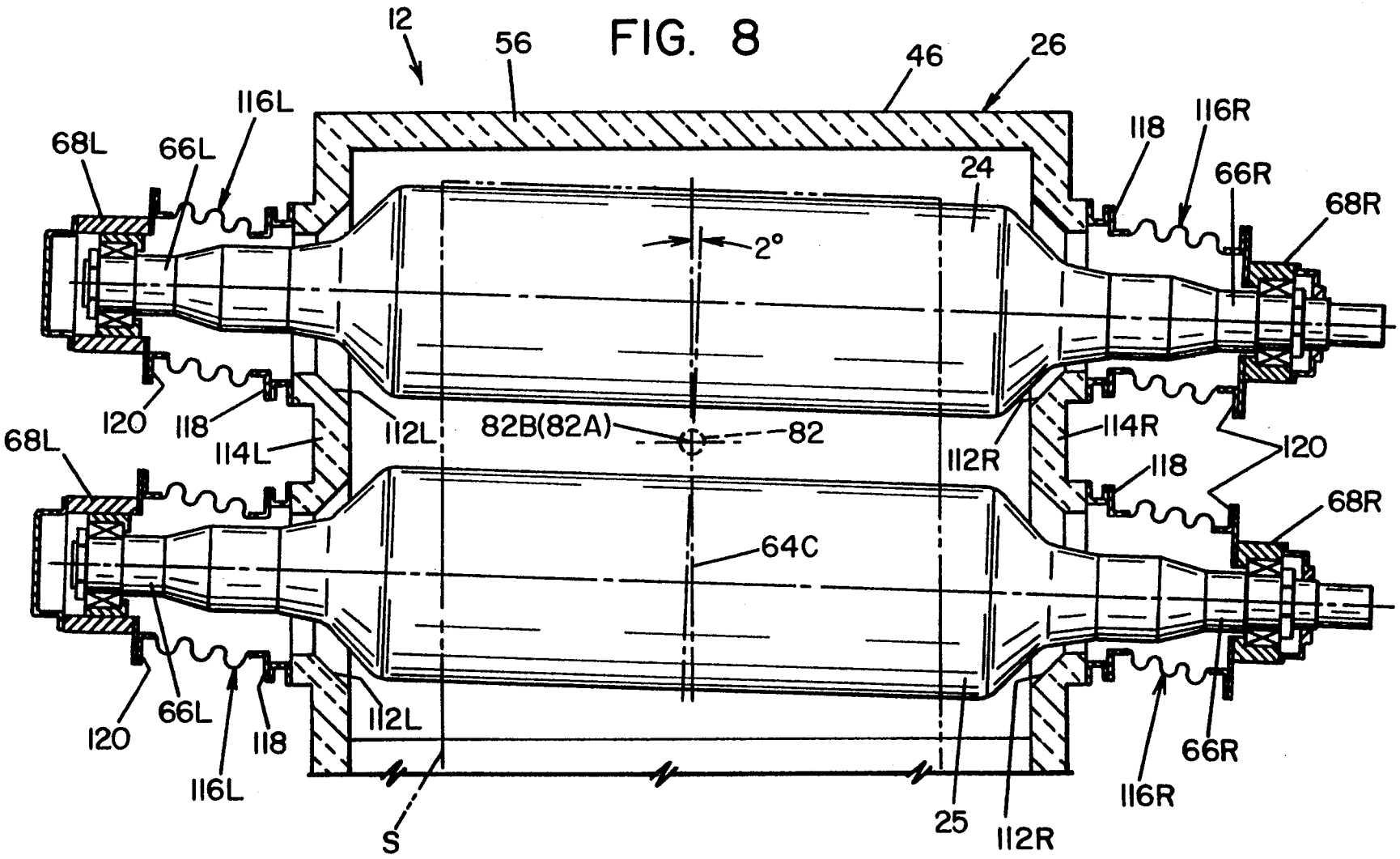
FIG. 8 is a fragmentary plan view of the hot bridle rolls, partially in section, taken substantially along the line 8—8 of FIG. 5.

Since rolls 24 and 25 are mounted on roll support stands 70L and 70R, any pivotal shifting of the pivot frame 62 will also pivotally shift the rolls a like amount. As shown in FIG. 8, rolls 24 and 25 pivot about pivot post 82 within a range of approximately 2° clockwise or 2° counterclockwise. Drive motor 84 is geared down so as not to impact transverse shock to the strip, but rather to effect any required adjustment at a slow steady pace. Thus, maximum strip correction from ±2° requires about ninety seconds. Since the hood 26 is stationary and the maximum arcuate movement is at the extremities of the roll stub shafts 66L and 66R, ample hood openings 112L and 112R are provided in the vertical side walls 114L and 114R of the hood 26 for horizontal pivotal movement of the stub shafts. In order to seal the openings 112 against invasion of air, flexible bellows type seals 116L and 116R are secured to walls 114L and 114R, respectively, to seal the perimeters of the openings 112 to bellows edge flanges 118. The opposite edge flanges 120 of the bellows are sealed to bearing housings 68. Thus, bellows edge flanges 118 are immovably secured to hood 26 and bellows 116 are sufficiently flexible to permit bellows edge flanges 120 to move with bearing housings 68 while at the same time maintaining sealing contact therebetween.

Figure 9:
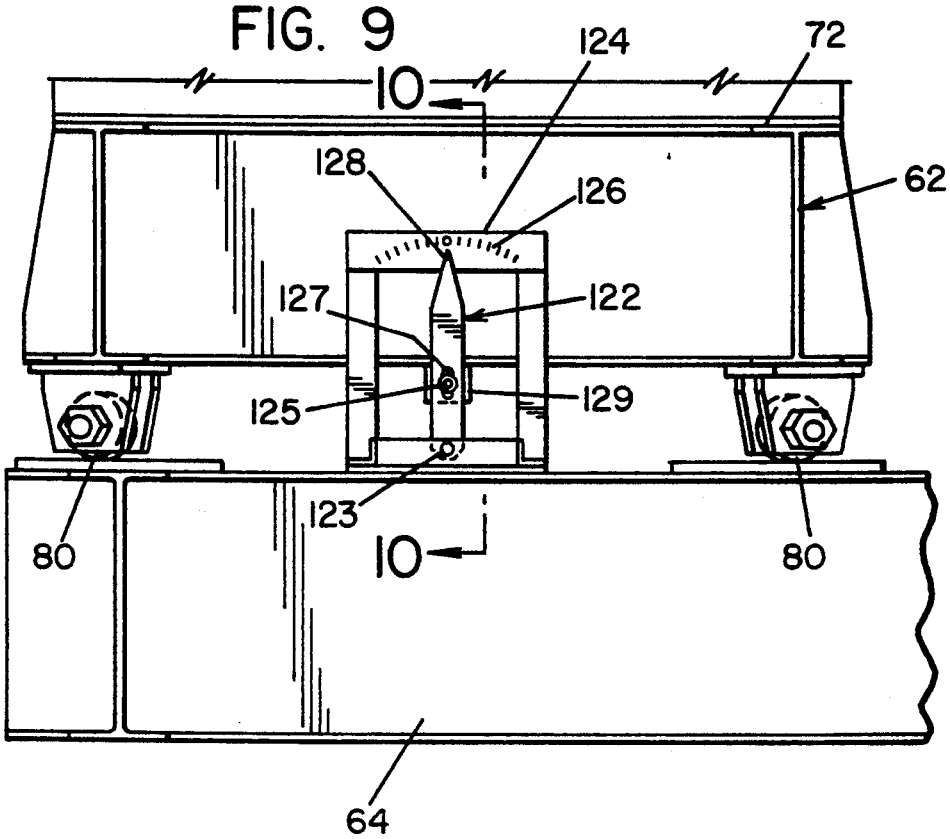
FIG. 9 is an elevational view of the hot bridle pivot frame taken along the line 9—9 of FIG. 6.
Figure 10:
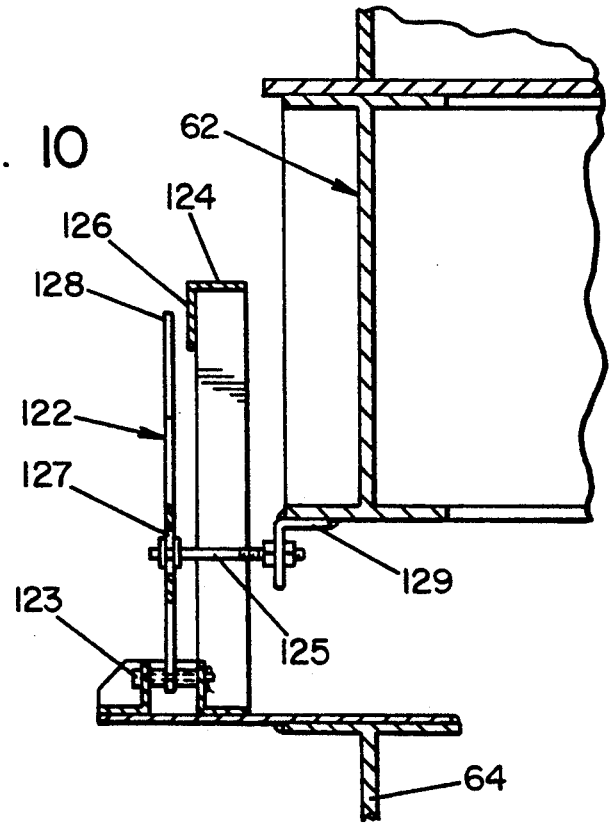
FIG. 10 is a fragmentary elevational view, partially in section, of the pivot frame indicator taken along the line 10—10 of FIG. 9.

Referring to FIGS. 9 and 10, pivot frame movement needle 122 is pivotally mounted on the main frame 64 to project vertically upward adjacent one side of a deflection scale 126 on frame 124, over which the tip 128 of needle 122 will sweep to indicate in digital increments the movement of pivot frame 62 to the right or left of the longitudinal center of the strip pass line. The needle 122 is pivotally secured at its base to main frame 64 on pivot pin 123. A second pin 125 is secured at one end to the pivot frame 62 by means of an angle bracket 129, and at its opposite end to a lost motion slot 127 in needle 122. Pin 125 will pivot needle 122 about pivot pin 123 as pin 125 is traversed substantially horizontally in lost motion slot 127.

The limits of pivotal movement of pivot frame 62 are defined by a pair of limit switches 130L and 130R secured to main frame 64, FIG. 7, astride the horizontal arc of movement of the pivot frame 62. Limit switch actuator probes 132L and 132R are secured to the underside of pivot frame 62 and aligned to actuate limit switches 130L and 130R, respectively, when a predetermined limit of arcuate movement of pivot frame 62 has been reached, either clockwise or counterclockwise. This limit switch system protects the strip and the line from damage in the event of a malfunction of the previously described pivot frame drive means. The limit switches may be adapted to actuate any line safety device including means to shut down the entire line until the triggering malfunction has been corrected. In the event of a power outage or other electrical malfunction, heavy duty bolts 131L and 131R are threadedly mounted in lugs 133L and 133R which are welded to the underside of pivot frame 62 to depend therefrom. Lock nuts 134L and 134R secure the bolts in place after they have been adjusted to proper lengths. In the event that limit switches 130 malfunction while pivot frame 62 is in motion, either bolt 131L or 131R will pivot into contact with main frame H beam stub 136, which contact will arrest any further pivotal movement of pivot frame 62.

Figure 11:
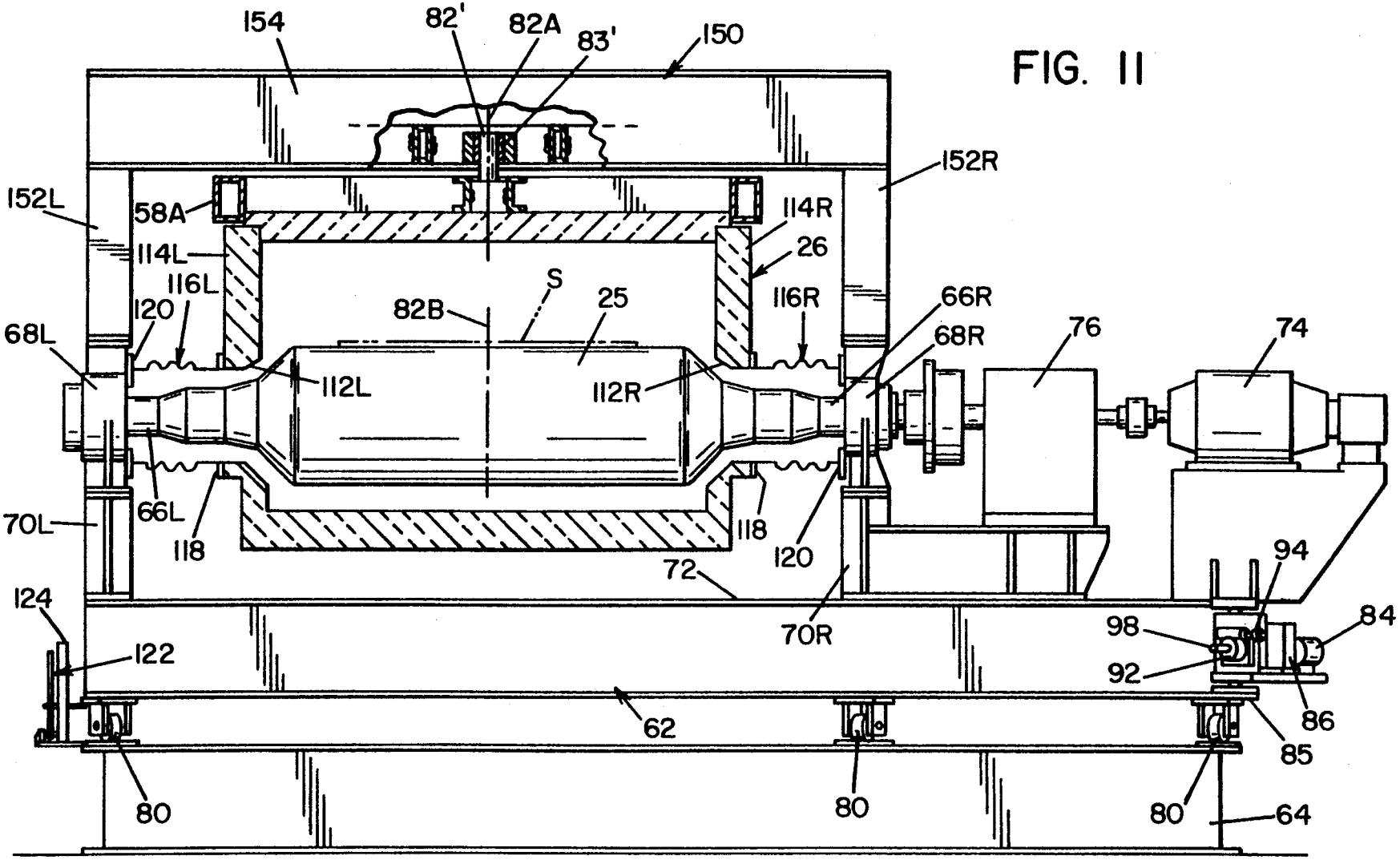
FIG. 11 is an elevational view of an embodiment of the invention in which the pivot means for the hot bridle rolls are positioned above the hot bridle hood.

Reference is now made to FIGS. 11 through 17, which illustrate other embodiments of the invention in which the pivot post and the pivot post sleeve are located in positions other than beneath the bridle hood. In this regard, attention is first directed to FIG. 11, which is similar to FIG. 5, and in which like numbers identify like parts. In FIG. 11 the pivot frame 62 and the means for operating it remain the same as shown in FIG. 5. However, a bridge 150, comprising vertical supports 152L and 152R and a horizontal span 154 provide mounting means for a pivot pin sleeve 83A to receive therein a pivot pin 82A. Pivot pin 82A is secured to stationary support frame 58A located above bridle hood 26. When the pivot frame 62 is pivotally shifted, the vertical axis of rotation of the pivot frame and hot bridle rolls 24 and 25 is defined by the location of pivot pin sleeve 83A secured to horizontal span 154 and pivot pin 82A secured to stationary support frame 58A.

Figure 12:
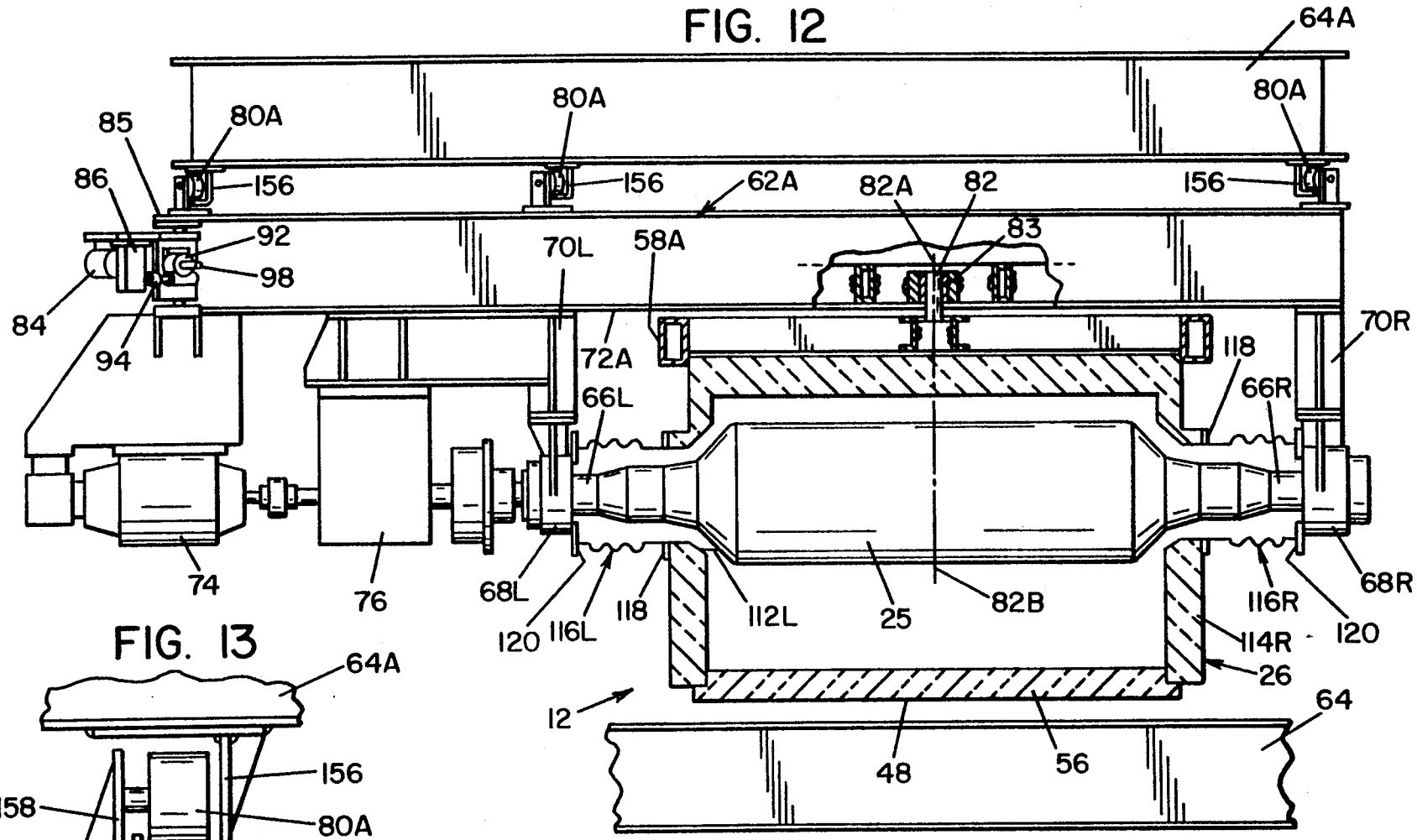
FIG. 12 is an elevational view of an embodiment of the invention similar to FIG. 5 but an inversion thereof.
Figure 13:
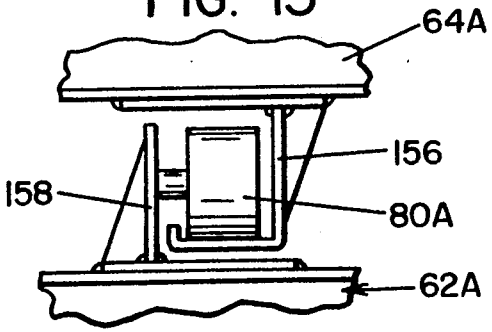
FIG. 13 is a fragmentary enlarged elevational view of the roller means for suspending the pivot frame above the hot bridle hood.

The apparatus shown in FIGS. 12 and 13 is substantially an inversion of FIG. 5, in which the pivot frame 62A is suspended from main frame 64A by means of short J-shaped tracks 156, welded to the underside of main frame 64A. Rollers 80A ride in J-shaped tracks 156 to support pivot frame 62A, hot bridle rolls 24 and 25, motor drive 74, gear box 76, and roll bearing housings 68L and 68R. Bridle hood 26 is immovably supported by main frame members, not shown.

There are circumstances when, because of space or for other reasons, it is desirable to control the pivoting of the bridle rolls from the side of the bridle hood, rather than from beneath the hood, as shown in FIG. 5, or from above the hood, as shown in FIGS. 11 and 12. FIGS. 14 through 17 disclose a yoke 168 for pivoting the hot bridle rolls. The yoke is located downstream of the bridle hood 26.

Figure 14:
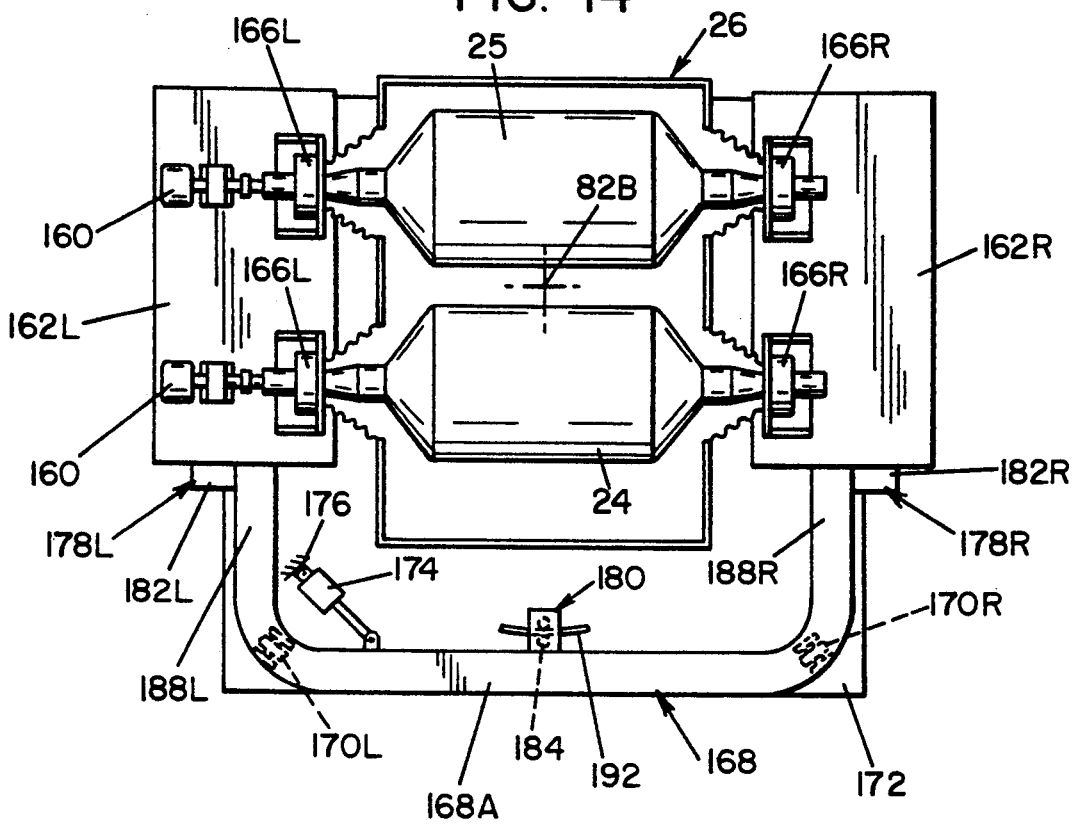
FIG. 14 is a plan view of an embodiment of the invention using yoke means to pivot the hot bridle rolls.
Figure 17:
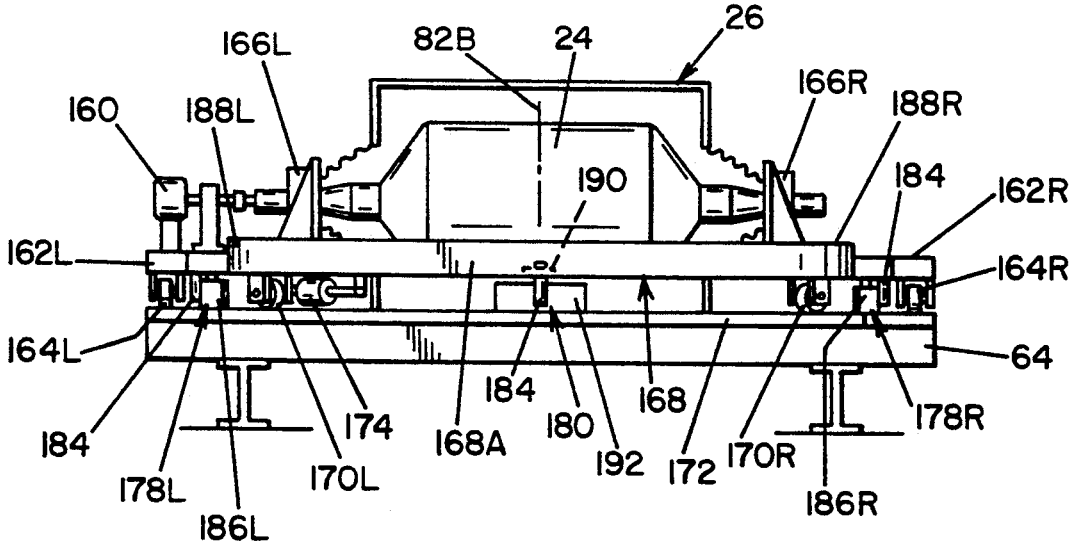
FIG. 17 is an elevational view of the embodiment of the invention shown in FIG. 14.

FIG. 14 shows the plan view of a pair of hot bridle rolls which are also shown in elevation in FIG. 17. On the left side of bridle hood 26 motor drives 160 and roll bearing housings 166L are mounted on a platform 162L which, in turn, is mounted on rollers 164L. On the right side of bridle hood 26, roll bearing housings 166R are mounted on platform 162R, which, in turn, is mounted on rollers 164R. A horizontal yoke 168 rigidly interconnects platforms 162L and 162R and is supported on rollers 170L and 170R. Rollers 170L and 170R are supported by and roll on a roller track 172.

Yoke 168 is arcuately shifted by drive means 174, which is pivotally connected between main frame portion 176 and yoke 168, FIG. 14. Arcuate shifting of yoke 168 is delimited by outboard roller means 178L and 178R and by intermediate roller means 180.

Figure 15:
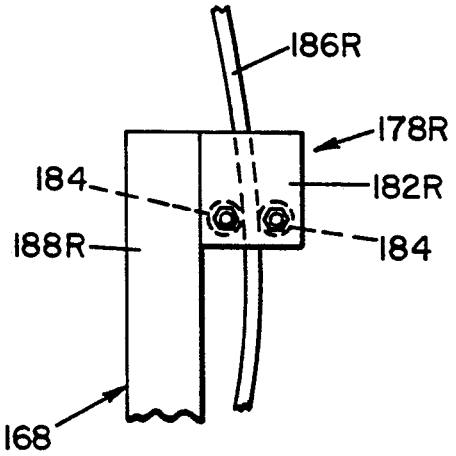
FIG. 15 is a fragmentary enlarged plan view of side roller guide means for controlling the movement of the yoke means of FIG. 14.

Roller means 178R, as shown in FIG. 15, comprises a roller housing 182R rigidly secured to the right arm 188R of yoke 168, a pair of rollers 184 and a curved plate roller race 186R. Roller means 178L is identical to roller means 178R except it is, of course, of opposite hand and is rigidly secured to the left arm 188L of yoke 168. Rollers 184 are placed in snug rolling contact with the opposite surfaces of roller race 186R, the curvature of which is defined by a radius which extends from the vertical axis of rotation of hot bridle rolls 24 and 25 to the roller race 186. Roller race 186R is rigidly secured to a portion of main frame 64, FIG. 17. As yoke 168 is shifted by drive means 174, FIG. 14, the movement of right arm 188R of yoke 168 will be guided by rollers 184 running on and guided by the opposite surfaces of roller race 186R. A roller race 186L, not shown, of opposite hand to roller race 186R, is similarly associated with roller means 178L.

Figure 16:
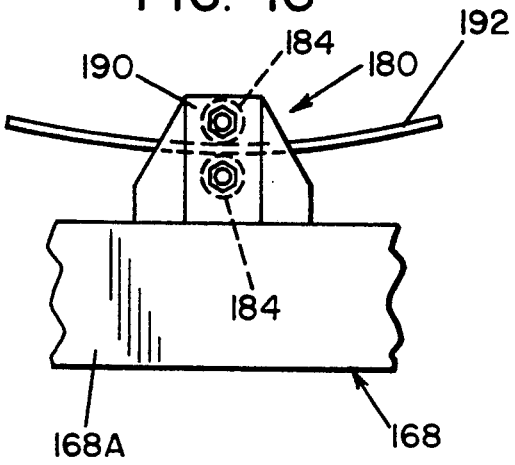
FIG. 16 is a fragmentary enlarged plan view of center roller guide means for controlling the movement of the yoke means of FIG. 14.

Roller means 180, FIGS. 14 and 16, is rigidly secured to yoke cross member 168A intermediate roller means 178L and 178R. This roller means comprises a roller housing 190; a pair of rollers 184; and a curved plate roller race 192. The curvatures of roller races 186L, not shown, 186R, and 192 define concentric circles, the centers of which lie on the vertical axis of rotation of hot bridle rolls 24 and 25. Thus, when all pairs of rollers are adjusted to snugly roll on adjacent surfaces of adjacent roller races, yoke 168 is constrained to arcuate movement about the axis of rotation of hot bridle rolls 24 and 25 to arcuately shift the hot bridle rolls in unison within hot bridle hood 26.

It will occur to those skilled in the art, having studied the described preferred embodiment of the invention, and having read the specification in conjunction with a study of the drawings, that certain modifications may be made to the invention. It is intended, however, that the invention be limited only by the scope of the appended claims.

What is claimed is:

1. In a strip metal processing line having a predetermined longitudinal center line, a horizontal main frame, a series of in-line strip processing devices mounted on said main frame, means to thread nd means to continuously transport metal strip through said devices, means to receive said strip from exit means of the last of said devices, horizontal hot bridle roll means positioned adjacent said exit means, a hot bridle hood having opposite sides and a hood strip entrance means in sealed engagement with said exit means of said last of said devices, the improvement comprising: means to immovably secure said hot bridle hood to said main frame; said hot bridle roll means having a vertical axis of arcuate movement, having opposite ends housed within said to bridle hood and having roll stub shaft means integral with and extending from said opposite ends of said hot bridle roll means; bridle roll mounting means to receive and to rotatably support said roll stub shaft means; bridle hood openings in said opposite sides of said hot bridle hood receiving said roll stub shaft means therethrough; pivot frame means; means to arcuately shift said pivot frame means in a horizontal plane about a vertical axis of arcuate movement; means to secure said bridle roll mounting means on said pivot frame means; and means to flexibly seal said roll stub shaft means between said opposite sides of said hot bridle hood and said bridle roll mounting means.

2. The strip metal processing line of claim 1, including a molten metal pot, and means to direct said metal strip from said hot bridle hood into said molten metal pot in atmosphere-controlled chute means.

3. The strip metal processing lien of claim 1, wherein said means to flexibly seal said rolls tube shaft means comprise: bellows type sleeves enclosing said stub shaft means and to form seals between said stub shaft means and said hot bridle hood and between said stub shaft means and said bridle roll mounting mean, whereby said stub shaft means may shift within said bridle hood openings without breaking said seals.

4. The trip metal processing line of claim 1, wherein said vertical axes of arcuate movement normally intersect said processing line longitudinal center line.

5. The strip metal processing line of claim 4, wherein said hot bridle roll means vertical axis of arcuate movement is concentric with said pivot frame means vertical axis of arcuate movement and equidistant form the remote ends of said roll stub shaft means, and wherein said pivotal movement of said pivot frame means simultaneously pivots said hot bridle roll means about said vertical axes of arcuate movement.

6. The strip metal processing line of claim 4, wherein said pivot frame means is mounted for pivotal movement on said main frame.

7. The strip metal processing lien of claim 4, wherein said pivot frame means vertical axis of arcuate movement is downstream of the said hot bridle roll means vertical axis of arcuate movement.

8. The strip metal processing line of claim 4, wherein said pivot frame means vertical axis of arcuate movement is upstream of the said hot bridle roll means vertical axis of arcuate movement.

9. The strip metal processing line of claim 4, wherein said pivot frame means is mounted on wheels for rolling on said main frame.

10. The strip metal processing line of claim 4, wherein said means to arcuately shift said pivot frame means comprises jack means secured between said main frame and said pivot frame means, and means to selectively extend or contract said jack means.

11. The strip metal processing line of claim 10, wherein said jack means is fluid pressure actuated.

12. The strip metal processing line of claim 10, wherein said jack means includes a rotatable threaded shaft threadedly engaged with a non-rotatable threaded nut and means to rotate said threaded shaft.

13. The strip metal processing line of claim 10, including means to drive said jack means and manual means to actuate and to control said drive means.

14. The strip metal processing line of claim 13, wherein said jack means includes computer means and sensor means positioned adjacent the path of said strip adapted to produce a signal responsive to sensed deviation of said strip from said predetermined longitudinal center line, said computer including means to receive and to analyze said signal and to command said drive means to extend or to contract responsive to said computer's analysis of said signal.

15. The strip metal processing line of claim 10, including visual pivot frame arcuate movement indicating means having a digital scales rigidly secured to said main frame, an indicator needle pivotally secured to said pivot frame means, and means to arcuately shift said indicator needle responsive to movement of said pivot frame means.

16. The strip metal processing lien of claim 15, wherein said indicator needle has an indicator portion, a mid portion, and a base portion, said indicator portion being positioned to arcuately sweep said digital scale; and said base portion being pivotally secured by first pivot pin means to said main frame; second pivot pin means; a lost motion slot in said mid portion of said indicator needle sized to receive said second pivot pin means therethrough; and means to secure said second pivot pin means to said pivot frame means normal thereto, whereby pivotal movement of said pivot frame means horizontally shifts said second pivot pin in said lost motion slot to arcuately shift said indicator needle about said first pivot pin means.

17. The strip processing line of claim 1, wherein said hot bridle roll means comprises two hot bridle rolls aligned to be rotatable about horizontal axes.

18. The strip processing line of claim 17, wherein said pivot frame means is adapted to arcuately shift said hot bridle roll means horizontally about said hot bridle roll means vertical axis of arcuate movement and wherein said hot bridle roll means axis of arcuate movement normally intersects said longitudinal center line of said processing line.

19. The strip metal processing line of claim 18, wherein said hot roll means vertical axis of arcuate movement passes midway between said horizontal axes of said tow hot bridle rolls and equidistant from the remote ends of said stub shaft means, and wherein said means to arcuately shift said pivot frame means simultaneously arcuately shifts said two hot bridle rolls supported thereon about said hot bridle roll means vertical axis of arcuate movement.

20. The strip processing line of claim 18, wherein said pivot frame means vertical axis of arcuate movement is downstream of said hot bridle roll means vertical axis of arcuate movement.

21. The strip processing line of claim 18, wherein said pivot frame means vertical axis of arcuate movement is upstream of said hot bridle roll means vertical axis of arcuate movement.

22. The strip metal processing line of claim 1, wherein said pivot frame means includes: a pivot frame having a top side and an under side; a bridge structure secured to said top side of said pivot frame including a horizontal span extending transversely over said hot bridle hood; rolls secured to said under side of said pivot frame for rolling on said main frame; pivot pin means interconnecting said horizontal span to said main frame; and means to arcuately shift said pivot frame and bridge structure about said pivot pin means.

23. The strip metal processing line of claim 1, wherein said pivot frame means includes: a horizontal pivot frame; a main frame horizontal span having an under side extending transversely over said hot bridle hood; said horizontal pivot frame having atop side extending transversely between said hot bridle hood and said main frame horizontal span; track hanger means secured to the said under side of said main frame horizontal span; rolls secured to the said top side of said horizontal pivot frame and positioned to be supported by and run in said track hanger means; pivot pin means interconnecting said pivot frame to said main frame horizontal span; and said means to arcuately shift shifts said horizontal pivot frame about said pivot pin means.

24. The strip metal processing line of claim 1, in which said hot bridle roll means have left roll stub shaft means and right roll stub shaft means, and wherein said horizontal pivot frame means includes: a left pivot frame having an under side beneath said left roll stub shaft means; a right pivot frame having an under side beneath said right roll stub shaft means; rolls secured to the said under sides of said left and right pivot frames, said rolls being positioned to roll on said main frame; and said means to arcuately shift includes a horizontal yoke means rigidly interconnecting said left and right pivot frames to arcuately shift said left and right pivot frames about said pivot frame means vertical axis of arcuate movement.

25. The strip metal processing line of claim 24, including arcuate race means secured to said main frame and roller means secured to said yoke and positioned to engage and to be guided by said race means, said arcuate race means comprising arcs of circles the centers of which are concentric with the said vertical axis of arcuate movement of said pivot frame means.

26. The strip metal processing line of claim 25, wherein said yoke is U-shaped having a pair of legs and a cross-piece joined to the base of each leg, each leg of said U-shaped yoke being secured to one of said separate pivot frames, said arcuate race means being secured to said main frame adjacent each of said yoke legs and adjacent said yoke cross-piece and defining concentric circles, the centers of which coincide with the said pivot frame vertical axis of arcuate movement of said left and right pivot frames, whereby the coaction of said roller means and said arcuate races defines a path of pivotal movement of said yoke.

* * * * *

UNITED STATES PATENT AND TRADEMARK OFFICE

CERTIFICATE OF CORRECTION

PATENT NO. : 5,279,666

DATED : Jan. 18, 1994

INVENTOR(S) : Kastenhuber et al.

It is certified that error appears in the above-identified patent and that said Letters Patent is hereby corrected as shown below:

Column 9,
Claim 1, line 21, change "nd" to --and--;
line 31, change "to" to --hot--; and Column 9,
Claim 3, line 55, change "mean" to --means--.

Column 9,
Claim 4, line 58, change "trip" to --strip--

Claim 5, line 64, change "form" to --from--

Column 10,
Claim 16, line 45, change "lien" to --line--

Column 11,
Claim 19, line 4, change "tow" to --two--.

Signed and Sealed this

Eighteenth Day of October, 1994

Bruce Lehman

*Attest:*

BRUCE LEHMAN

*Attesting Officer*

*Commissioner of Patents and Trademarks*